United States Patent [19]

Simmen

[11] Patent Number: 4,507,833

[45] Date of Patent: Apr. 2, 1985

[54] JET TEXTURING NOZZLE

[75] Inventor: Christian Simmen, Lichtensteig, Switzerland

[73] Assignee: Heberlein Maschinenfabrik AG, Wattwil, Switzerland

[21] Appl. No.: 469,683

[22] Filed: Feb. 25, 1983

[30] Foreign Application Priority Data

Mar. 10, 1982 [CH] Switzerland ..... 1472/82

[51] Int. Cl.[3] ..... D02G 1/16

[52] U.S. Cl. ..... 28/254

[58] Field of Search ..... 28/254, 257, 272, 273, 28/271

[56] References Cited

U.S. PATENT DOCUMENTS

| | | | |
|---|---|---|---|
| 3,259,952 | 7/1966 | Caines | 28/273 |
| 3,724,038 | 4/1973 | Chimura et al. | 28/273 |
| 4,040,154 | 8/1977 | Riley | 28/273 X |
| 4,097,975 | 7/1978 | Moeller | 28/254 |
| 4,290,177 | 9/1981 | Price et al. | 28/254 |

FOREIGN PATENT DOCUMENTS

| | | | |
|---|---|---|---|
| 0088254 | 9/1983 | European Pat. Off. | 28/254 |
| 618221 | 12/1978 | Switzerland . | |
| 2093872 | 9/1982 | United Kingdom . | |

*Primary Examiner*—Werner H. Schroeder
*Assistant Examiner*—Andrew M. Falik
*Attorney, Agent, or Firm*—Young & Thompson

[57] ABSTRACT

A texturing device consists of nozzle (1) with a guide duct (2) and a radial bore for feeding a pressure medium terminating in the guide duct. The duct is outwardly flared with a convexly curved outlet opening (2'), and a spherical or semispherical guide element (5) extending into the outlet opening and forming therewith an annular gap (4). The outer diameter of the outlet opening (2') corresponds to at least four times the diameter of the duct (2) and to at least 0.5 times the diameter of the guide element (5).

15 Claims, 6 Drawing Figures

Figure 4:
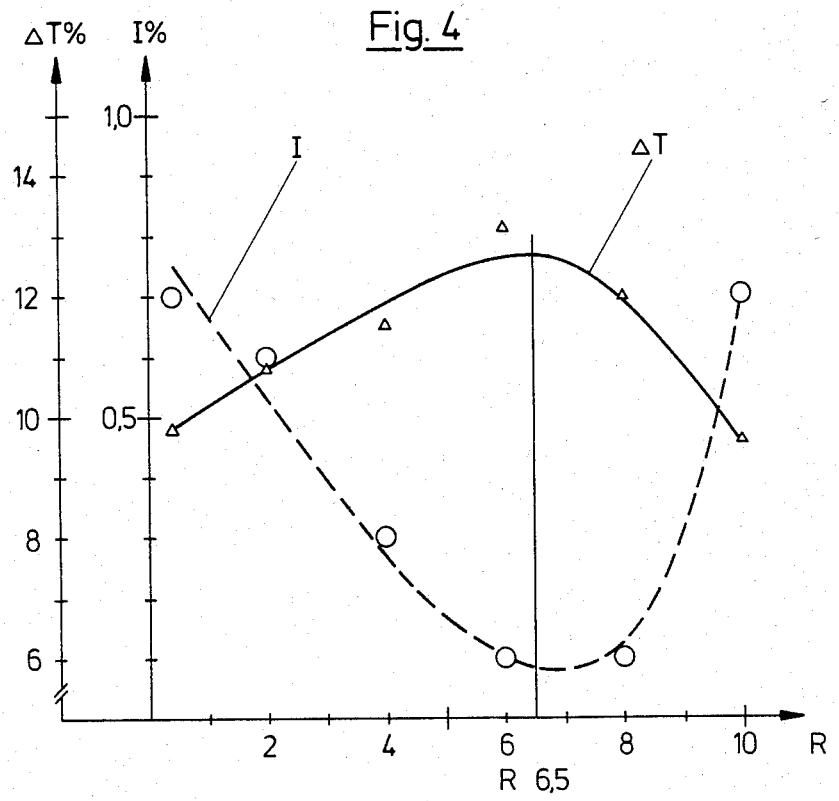

Fig. 1
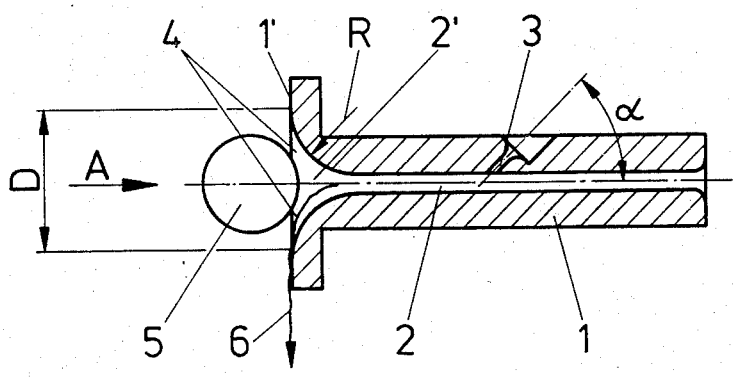
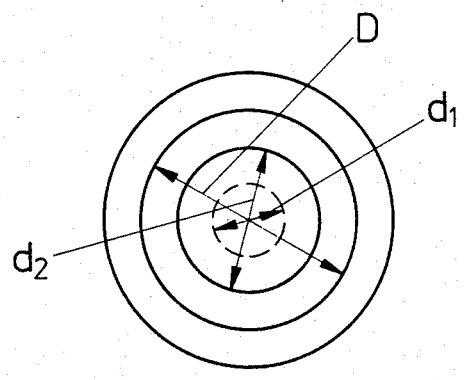
Fig. 2
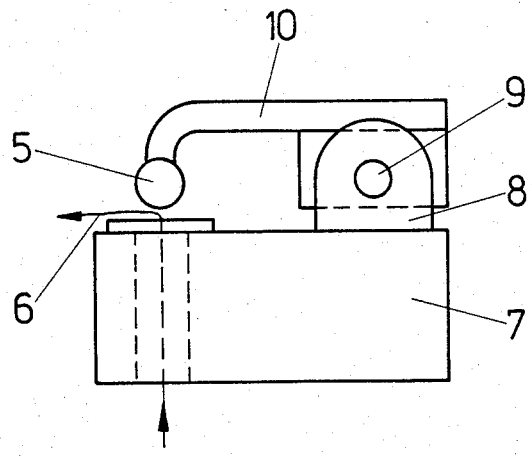
Fig. 3

15
10
5
q̇v
[Nm³/h]
4
5
6
7
8
9
10
P
[bar]

JET TEXTURING NOZZLE

The invention relates to a device for texturing at least one endless yarn consisting of a plurality of filaments, with a nozzle supplied by a pressure medium.

Swiss Pat. No. 618,221 discloses a texturing device for the treatment of at least one endless yarn consisting of a plurality of filaments, comprising a nozzle equipped with a yarn feed duct and an adjacent swirl chamber. At least one radially oriented duct serving for the feeding of compressed air terminates in the swirl chamber, and an extension is arranged following this chamber and forming with the latter a coaxial, conical passage opening. A guide element engages into this passage opening and forms therewith an annular gap. The guide element is provided with a semispherical surface facing the swirl chamber with the formation of a spacing.

This design of the nozzle achieves, as compared with other known devices of this type, an improved texturing effect and a lower air consumption. However, it has been found that air consumption and thus expenditure in energy are still too high for obtaining economical production.

British Patent Application No. 2,093,872 describes another device of this type wherein the yarn feed duct has a diameter of 1.2–2.5 mm and exhibits two mutually diametrically opposed radial bores for the feeding of the pressure medium, the points of termination of these bores in the duct being offset with respect to each other.

Air consumption is reduced by more than 30% by the use of only two radial bores, instead of three radial bores as known from Swiss Pat. No. 618,221, for supplying the pressure medium. By offsetting the terminations of the bores in the duct, the objective is attained that the individual filaments of the endless yarn can be more readily separated and thereafter are subjected to more intense intermingling.

It has now been found that in case of yarns textured in accordance with the aforedescribed process, the yarn stability, i.e. preservation of yarn characteristics during the processing step as well as thereafter, represents an important criterion for the usability of such yarns. Furthermore, the degree of intermingling of the individual filaments of the textured yarns is also of essential importance for obtaining a uniform yarn appearance.

The invention is based on the object of providing an improved device of the above-disclosed type, making it possible to attain an optimum texturing effect ensuring a high stability of the yarn, as well as a high degree of intermingling of the individual filaments.

The applicant has recognized the fact that, by using a nozzle having a convexly, preferably circularly curved, relatively large outlet opening of the yarn guide duct, an excellent texturing effect and high stability of the yarn are obtained, as well as a high degree of penetration of the individual filaments and regular loop distribution along the thread axis.

The design of the nozzle according to this invention furthermore makes it possible to reduce the number of radial bores for supplying the pressure medium to a single bore when manufacturing textured yarns having fiber weights of 70–700 dtex, without impairing the texturing effect. This aspect provides a further reduction in air consumption.

Figure 5:
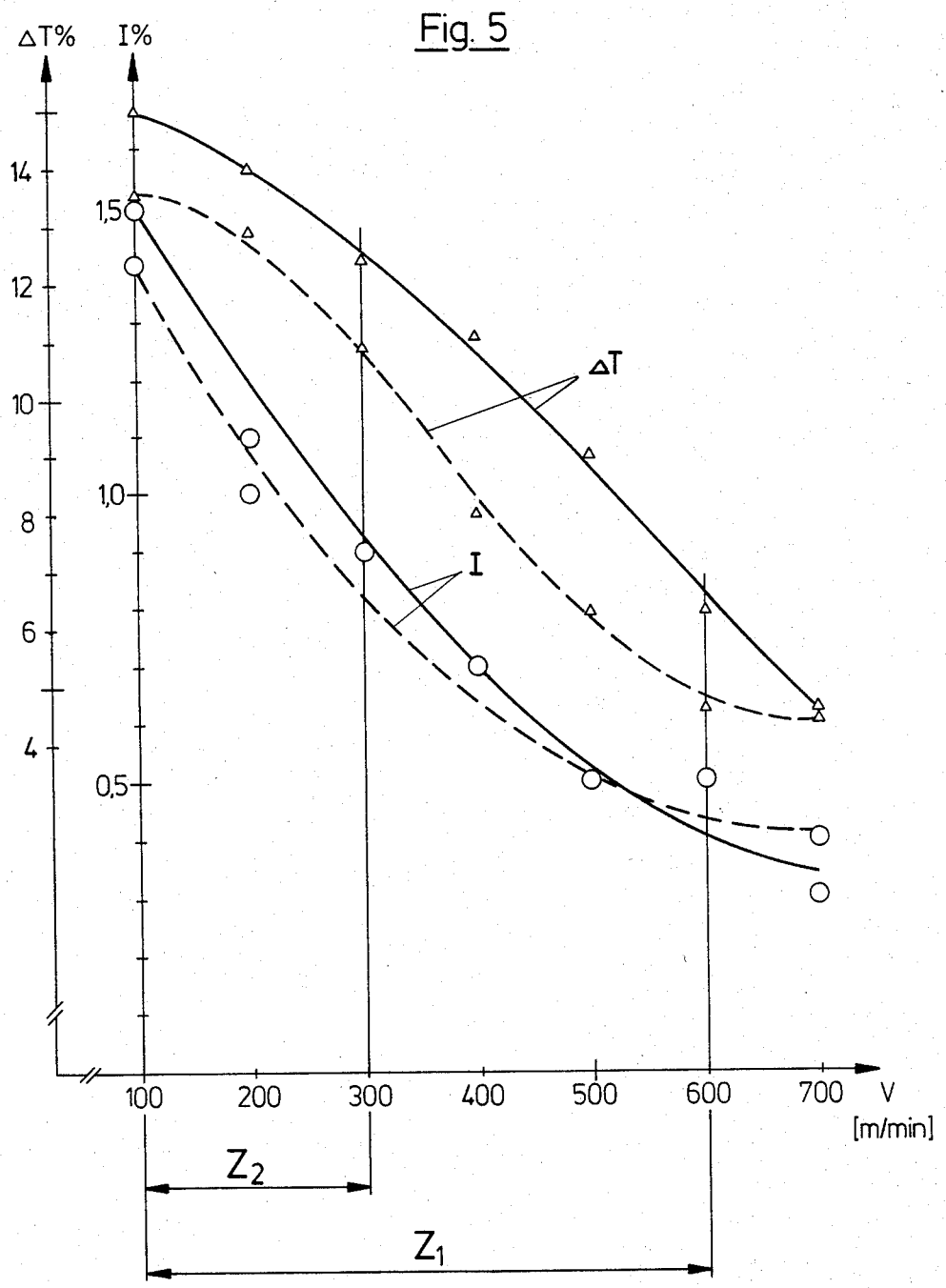
Figure 6:
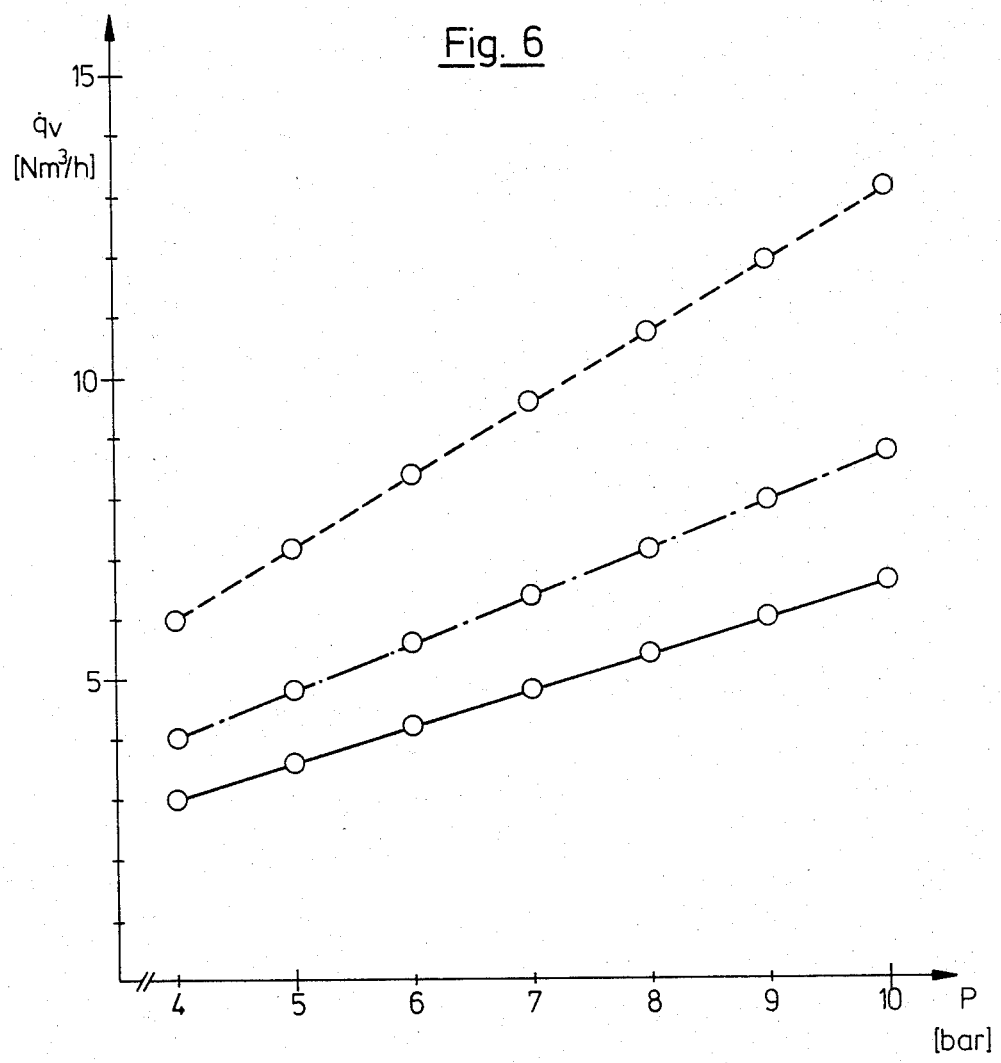

One embodiment of the invention will be explained in greater detail below with reference to the figures of the drawing wherein:

FIG. 1 is a section through the nozzle according to this invention along the longitudinal line of symmetry, FIG. 2 shows a view of the nozzle in the direction of arrow A in FIG. 1, FIG. 3 is a lateral view of the entire texturing device, FIG. 4 is a diagram for illustrating a series of tests with various circular-arc radii of the curvature of the outlet opening for the yarn guide duct, FIG. 5 is a diagram for illustrating a series of tests with varying texturing speeds, and FIG. 6 is a diagram to illustrate comparative tests regarding air consumption.

The nozzle 1 shown in FIGS. 1 and 2 has a yarn guide duct 2, the yarn 6 to be textured traveling through this duct. The duct 2 is supplied with compressed air via a lateral bore 3 from a compressed-air tank, not shown. The axis of the bore 3 forms an angle $\alpha$ of 48° with the axis of the duct 2. The diameter of the bore 3 is 1.1 mm. The duct 2 has a diameter $d_1$ of 1.5 mm and exhibits an outwardly flaring, convexly curved outlet opening 2'. The convex curvature has the shape of a circular arc having a radius R of 6.5 mm; the end face 1' of the nozzle 1 forms a tangential plane with this arc. The contact points of the curvature arcs with the tangential plane lie on a circle having the diameter D. The diameter D corresponds to the formula $D=d_1+2R$ and thus amounts to 14.5 mm.

As can be seen from FIG. 1, a spherical guide element 5, the diameter of which is $d_2=12.5$ mm, projects partially into the duct outlet opening 2' and forms an annular gap 4 with the inner wall of the opening. The yarn 6 exiting from the nozzle is taken off via the rim of the outlet opening 2'.

As illustrated in FIG. 3, an axle 9 is mounted on a carrier 8 on the housing 7 supporting the nozzle; a lever 10 firmly joined to the guide element 5 can be pivoted about this axle. By pivoting the lever 10, the annular gap 4 can be adjusted and/or the guide element 5 can be lifted off.

The advance in the art provided by the device of this invention will be demonstrated below with reference to actually performed experiments.

A multifilament yarn of polyester having a titer of 167 f 68 dtex was textured with the aforedescribed device, using different nozzles 1. The various nozzles differed by the radii R of the convex, circular-arc-shaped curvature of the duct outlet opening 2'. The results of this test series are illustrated in the diagram of FIG. 4, the ordinate showing the increase in titer $\Delta T$ of the yarn and its instability I in percent, and the abscissa showing the radius R of the circular-arc-shaped curvature of the duct outlet opening 2'. The curve shown in a solid line illustrates the course of titer increase $\Delta T$, and the dashed curve shows the course of instability I. As can be derived therefrom, a clear maximum for $\Delta T$ and a minimum for I exist in the range of R=5–7 mm, i.e. optimum texturing conditions prevail.

To determine the instability I of the yarn, small yarn strands with four windings of one meter each in circumference are formed on a reel. These strands are then stressed for one minute with 25 cN and thereafter the length x is determined. This is followed by stressing for likewise one minute with 1250 cN. After relieving the load, the strand is again stressed with 25 cN after one minute and, after another minute, the length y is then determined. This yields the value for the instability:

$$I=(y-x)/x\cdot 100\%$$

This equation indicates the amount of permanent elongation in percent produced by the applied load.

In a second test series, a multifilament blended yarn of polyester having a titer of 167 f 68×2 dtex and polyamide 6,6 with a titer of 78 f 34 dtex was textured at varying yarn take-off speeds v and with a constant pressure of 9 bar, determining the increase in titer ΔT and the instability I in dependence on the speed v. For comparison purposes, the texturing was conducted, besides being carried out by means of the aforedescribed device of this invention, with a device according to Swiss Pat. No. 618,221 with three radial bores for supplying the compressed air. The results of these tests can be seen from the diagram illustrated in FIG. 5. The curves in solid lines show the course of titer increase ΔT and of the instability I when texturing with the device of this invention, and the dashed-line curves show the course of these variables when texturing with the device according to Swiss Pat. No. 618,221.

In the speed range denoted by $Z_1$, satisfactory intermingling of the individual filaments is achieved when texturing with the device of this invention, and in the range denoted by $Z_2$, satisfactory intermingling of the filaments takes place when texturing with the device of Swiss Pat. No. 618,221. As can be seen, with the use of the device according to this invention, the satisfactory intermingling of the filaments is attained up to speeds of 600 m/min, whereas when using the conventional device, such effect is achieved merely up to 300 m/min.

Finally, in the diagram of FIG. 6, the air consumption q is illustrated in dependence on the air pressure p (gauge pressure) within the nozzle, the solid-line curve showing the air consumption with the device of this invention, while the dashed-line curve shows the air consumption with the device of Swiss Pat. No. 618,221, and the dot-dash curve shows the air consumption with the installation according to British patent application No. 2,093,872. As can be seen therefrom, a considerable reduction in air consumption is attainable by means of the device according to the present invention.

What is claimed is:

1. In a device for texturing at least one endless yarn consisting of a plurality of filaments, with a nozzle (1) supplied with a pressure medium, containing a yarn guide duct (2), at least one feed means (3) for the pressure medium terminating in the duct, an outwardly flaring, convexly curved outlet opening (2') of the duct (2), and a spherical or semispherical guide element (5) extending into the outlet opening and forming therewith an annular gap (4); the improvement in which the outer diameter (D) of the convexly curved outlet opening (2') of the duct (2) is at least equal to four times the diameter ($d_1$) of the duct and at least equal to 0.5 times the diameter ($d_2$) of the spherical or semispherical guide element (5).

2. Device according to claim 1, characterized in that the convex curvature of the outlet opening (2') of the duct (2) is of a circular arc shape.

3. Device according to claim 2, characterized in that, with a diameter ($d_1$) of the duct (2) from 1.2 to 1.6 mm, the radius (R) of the curvature arc is 5 to 8 mm.

4. Device according to claim 3, characterized in that the diameter ($d_2$) of the spherical or semispherical guide element (5) is 6 to 15 mm.

5. Device according to claim 2, characterized in that, with a diameter ($d_1$) of the duct (2) of 1.8 to 2.5 mm, the radius (R) of the curvature arc is 7 to 12 mm.

6. Device according to claim 5, characterized in that the diameter ($d_2$) of the spherical or semispherical guide element (5) is 6 to 15 mm.

7. Device according to claim 1, characterized in that the device comprises a single radial bore (3) for feeding the pressure medium.

8. In a device for texturing at least one endless yarn consisting of a plurality of filaments, with a nozzle (1) supplied with a pressure medium, containing a yarn guide duct (2), at least one feed means (3) for the pressure medium terminating in the duct, an outwardly flaring, convexly curved outlet opening (2') of the duct (2), and a spherical or semispherical guide element (5) extending into the outlet opening and forming therewith an annular gap (4); the improvement in which the outer diameter (D) of the convexly curved outlet opening (2') of the duct (2) is at least equal to four times the diameter ($d_1$) of the duct and at least equal to 0.5 times the diameter ($d_2$) of the spherical or semispherical guide element (5), an end face (1') of the nozzle (1) forming a tangential plane with respect to the convex curvature of the outlet opening (2') of the duct (2).

9. Device according to claim 8, characterized in that the convex curvature of the outlet opening (2') of the duct (2) is of a circular arc shape.

10. Device according to claim 9, characterized in that, with a diameter ($d_1$) of the duct (2) from 1.2 to 1.6 mm, the radius (R) of the curvature arc is 5 to 8 mm.

11. Device according to claim 10, characterized in that the diameter ($d_2$) of the spherical or semispherical guide element (5) is 6 to 15 mm.

12. Device according to claim 9, characterized in that, with a diameter ($d_1$) of the duct (2) of 1.8 to 2.5 mm, the radius (R) of the curvature arc is 7 to 12 mm.

13. Device according to claim 12, characterized in that the diameter ($d_2$) of the spherical or semispherical guide element (5) is 6 to 15 mm.

14. Device according to claim 8, characterized in that the device comprises a single radial bore (3) for feeding the pressure medium.

15. Device according to claim 8, characterized in that the convex curvature of the outlet opening (2') of the duct (2) is of a circular arc shape and the diameter (D) of the tangent circle of the curvature arc with the tangential plane corresponds to the formula $$D = d_1 + 2R.$$

* * * * *